US008072129B2

(12) United States Patent
Custodis et al.

(10) Patent No.: US 8,072,129 B2
(45) Date of Patent: Dec. 6, 2011

(54) LAMP HAVING SWITCHING ARRANGEMENT

(75) Inventors: Udo Custodis, Hong Kong (HK); Werner Schmidts, Ottobrunn (DE)

(73) Assignee: OSRAM AG, Munich (DE)

( * ) Notice: Subject to any disclaimer, the term of this patent is extended or adjusted under 35 U.S.C. 154(b) by 527 days.

(21) Appl. No.: 11/988,546

(22) PCT Filed: Jul. 4, 2006

(86) PCT No.: PCT/DE2006/001157

§ 371 (c)(1),
(2), (4) Date: Jan. 10, 2008

(87) PCT Pub. No.: WO2007/006266

PCT Pub. Date: Jan. 18, 2007

(65) Prior Publication Data

US 2009/0146539 A1 Jun. 11, 2009

(30) Foreign Application Priority Data

Jul. 11, 2005 (DE) ..... 10 2005 032 315

(51) Int. Cl.
*H01J 5/48* (2006.01)
*F21V 23/00* (2006.01)

(52) U.S. Cl. ..... 313/318.01; 313/318.02; 439/438; 362/228; 362/222; 362/217.06

(58) Field of Classification Search ..... 313/318.01, 313/318.06
See application file for complete search history.

(56) References Cited

U.S. PATENT DOCUMENTS

| | | | | |
|---|---|---|---|---|
| 1,203,576 | A | 11/1916 | Broadhead | |
| 4,631,377 | A * | 12/1986 | Imazeki et al. | 200/313 |
| 4,872,099 | A * | 10/1989 | Kelley et al. | 362/295 |
| 5,594,433 | A * | 1/1997 | Terlep | 340/908.1 |
| 6,042,487 | A * | 3/2000 | Schrimmer et al. | 473/353 |
| 6,171,135 | B1 * | 1/2001 | Yang | 439/456 |
| 6,400,104 | B1 * | 6/2002 | Ham | 315/312 |
| 6,580,228 | B1 | 6/2003 | Chen et al. | |
| 7,862,200 | B2 * | 1/2011 | Custodis et al. | 362/217.06 |
| 2002/0118538 | A1 * | 8/2002 | Calon et al. | 362/236 |
| 2002/0191396 | A1 * | 12/2002 | Reiff et al. | 362/246 |
| 2004/0264187 | A1 | 12/2004 | Vanderschuit | |
| 2005/0077837 | A1 | 4/2005 | Kim et al. | |
| 2006/0238136 | A1 * | 10/2006 | Johnson, III et al. | 315/185 R |

FOREIGN PATENT DOCUMENTS

| | | |
|---|---|---|
| DE | 298 09 282 | 7/1998 |
| DE | 201 16 7719 | 1/2002 |
| WO | WO 02/062106 | 8/2002 |

* cited by examiner

*Primary Examiner* — Sikha Roy

(57) ABSTRACT

A lamp includes at least one luminous source (14, 6, 8), in particular a low-pressure discharge lamp, for producing main illumination and having at least one alternative luminous element (22), in particular a light-emitting diode arrangement having at least one LED, for producing alternative illumination, which are arranged on a cap (12), and having electronics, wherein a switching arrangement, which can be actuated manually, for operating the lamp in the main illumination mode, the alternative illumination mode or in both illumination modes at the same time is provided in the cap.

14 Claims, 3 Drawing Sheets

LAMP HAVING SWITCHING ARRANGEMENT

TECHNICAL FIELD

The invention relates to a lamp with at least one light source and at least one alternative luminous means in accordance with the precharacterizing clause of patent claim 1.

PRIOR ART

Such a lamp is known, for example, from DE 201 16 719 U1 as a nightlight lamp. The lamp is in the form of a discharge lamp with two discharge vessels for producing a main illumination and an LED for producing an alternative illumination. The main illumination and the alternative illumination are switched on alternately via a wall switch and an electrical resistor, which is connected in parallel with the wall switch, the lamp being operated in the main illumination mode when the wall switch is switched on and in the alternative illumination mode when the wall switch is switched off. In order to prevent the lamp from switching to the alternative illumination mode given sufficient brightness when the wall switch is switched off, a photoelement is provided. One disadvantage of this solution is that it is not possible to intentionally choose between the main illumination and the alternative illumination, but that the lamp automatically changes to the alternative illumination mode when the wall switch is switched off and in the case of reduced brightness.

A lamp with a discharge vessel and an LED in which the LED, i.e. the alternative illumination, can be switched on or off intentionally is disclosed in WO 02/062106 A1. This lamp provides control electronics, which are connected to power supply lines of the discharge vessel and the LED in such a way that the lamp can be operated in the main illumination mode, in the alternative illumination mode or in both illumination modes at the same time as a function of an actuation sequence of a wall switch. One disadvantage with this solution is that complex control electronics and a complicated actuation sequence of the wall switch are required for intentionally switching on the alternative illumination.

DESCRIPTION OF THE INVENTION

The invention is based on the object of providing a lamp with at least one light source and an alternative luminous means, which lamp makes it possible. to manually switch over between individual operating or illumination modes given minimum complexity in terms of apparatus.

This object is achieved as regards the lamp by the combination of features of patent claim 1. Particularly advantageous embodiments of the invention are described in the dependent claims.

The lamp according to the invention provides at least one light source, in particular a low-pressure discharge lamp, for producing a main illumination and at least one alternative luminous means, in particular a light-emitting diode arrangement with at least one LED, for producing an alternative illumination. The light source and the alternative luminous means are arranged on a base, in which corresponding electronics are accommodated. In order to operate the lamp in the main illumination mode, alternative illumination mode or in both illumination modes at the same time, a manually actuable switching arrangement is provided in accordance with the invention in the base.

The manually actuable switching arrangement in the lamp base has the advantage that it is possible to dispense with complex control electronics and a complicated actuation sequence of a wall switch as described, for example, in the document WO 02/062106 A1 mentioned at the outset in order to be able to change between the illumination modes.

In a preferred embodiment, the manually actuable switching arrangement has a slide, which produces an electrical connection between an electrical line of the electronics and an electrical contact element of a power supply line of the light source or the alternative luminous means. Of course the electrical connection can also be produced via the slide at the same time with the two contact elements. Preferably, the electrical line is fixed on the slide in such a way that it has a line section extending in the sliding direction for the purpose of making contact with at least one of the contact elements.

In order to actuate the slide, it can have two projections, which extend from its opposite narrow sides through two recesses, which are preferably arranged diametrically with respect to one another in the base cover.

In one embodiment, a switching position or a displacement of the slide is defined by end faces of the slide running onto inner circumferential sections of the base cover in the region of the recesses.

The contact element of the power supply line of the light source and the contact element of the power supply line of the alternative luminous means can be arranged on an extension of a dome bearing the LED, which extension extends through the base cover. Advantageously, the extension has two opposite cutouts for passing through the slide, the contact elements each being arranged in a corner region of the cutouts.

The luminous means preferably has a discharge vessel.

BRIEF DESCRIPTION OF THE DRAWINGS

The invention will be explained in more detail below with reference to a preferred exemplary embodiment. In the drawings.

PREFERRED EMBODIMENT OF THE INVENTION

Figure 1:
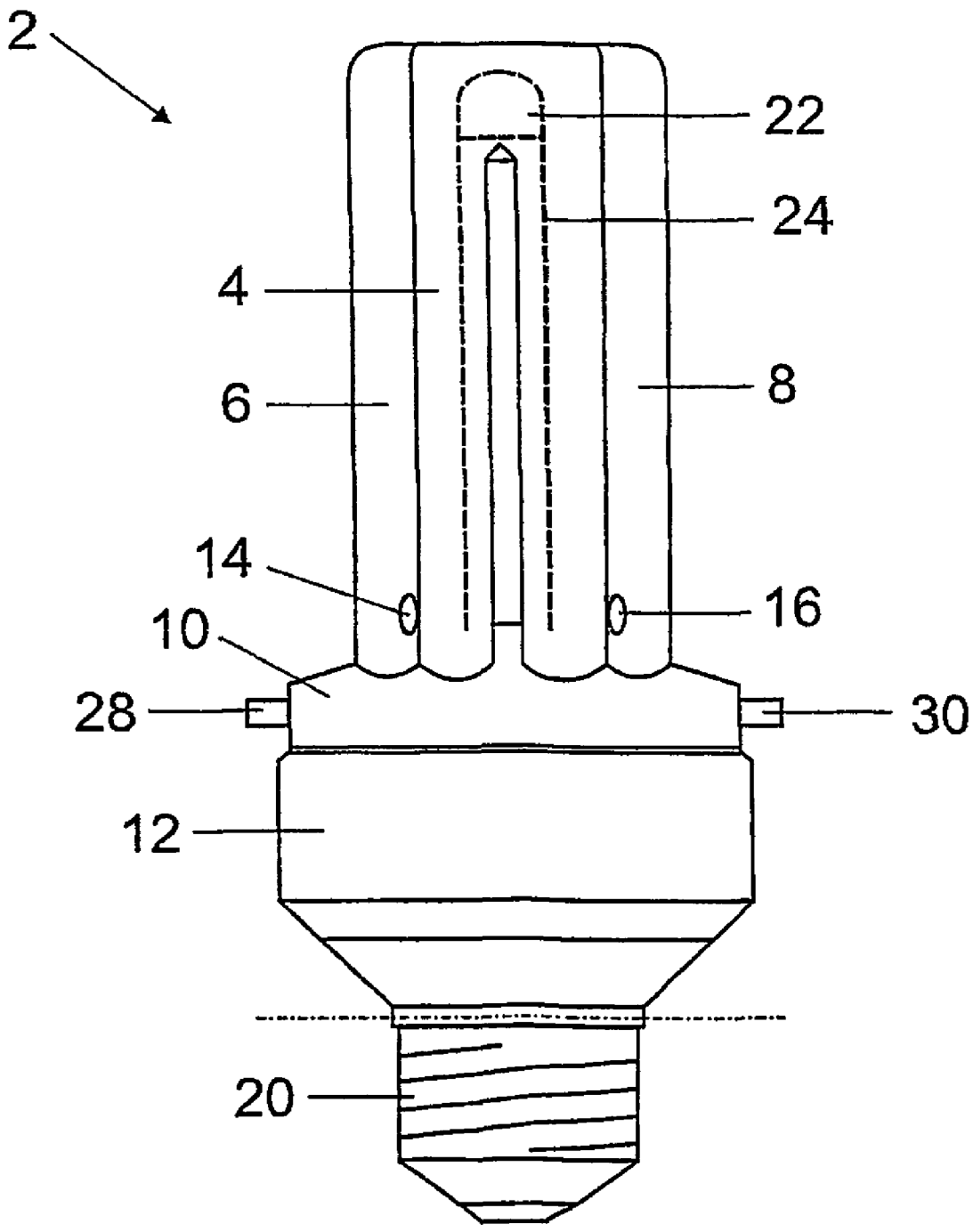
FIG. 1 shows a schematic side view of a preferred embodiment of the lamp according to the invention.

FIG. 1 shows a side view of a preferred embodiment of a lamp 2 according to the invention. The lamp 2 is preferably in the form of a compact fluorescent lamp with a low-pressure discharge lamp as the light source for producing a main illumination. The light source has a discharge vessel with three U-shaped discharge tubes 4, 6, 8, which are arranged on a base cover 10 of a base 12. The discharge tube 4 is connected to the discharge tube 6 and the discharge tube 8 via in each case one connecting web 14, 16, so that a common discharge space is formed. In order to accommodate the lamp 2 in a lampholder (not illustrated), a thread section 20 is formed on the base 12.

Furthermore, the lamp 2 has an alternative luminous means 22 (indicated by dashed lines), preferably a light-emitting diode arrangement, for producing an alternative illumination. In the exemplary embodiment shown, the light-emitting diode arrangement comprises a light-emitting diode or LED. In order not to subject the LED 22 to excessively high thermal loading by means of the main illumination, it is arranged on a dome or extender 24, which extends from the base cover 10 between the discharge tubes 4, 6, 8 up to discharge tube regions, the so-called "cold spots", which are horizontal in the illustration in the figure, so that the LED 22 is positioned in a region which is subjected to a low thermal load.

In order to operate the lamp 2 in the main illumination mode, in the alternative illumination mode or in both illumination modes at the same time, a manually actuable switching arrangement is provided in the base 12, of which switching arrangement two projections 28, 30 of a slide for actuating the latter are shown in FIG. 1. The switching arrangement as shown in the following figures substantially comprises the slide 32, contact elements 34, 36, which are connected to power supply lines of the light source 4, 6, 8 and the LED 22, and a line section 38 of an electrical line 40 of electronics accommodated in the base 12.

Figure 2:
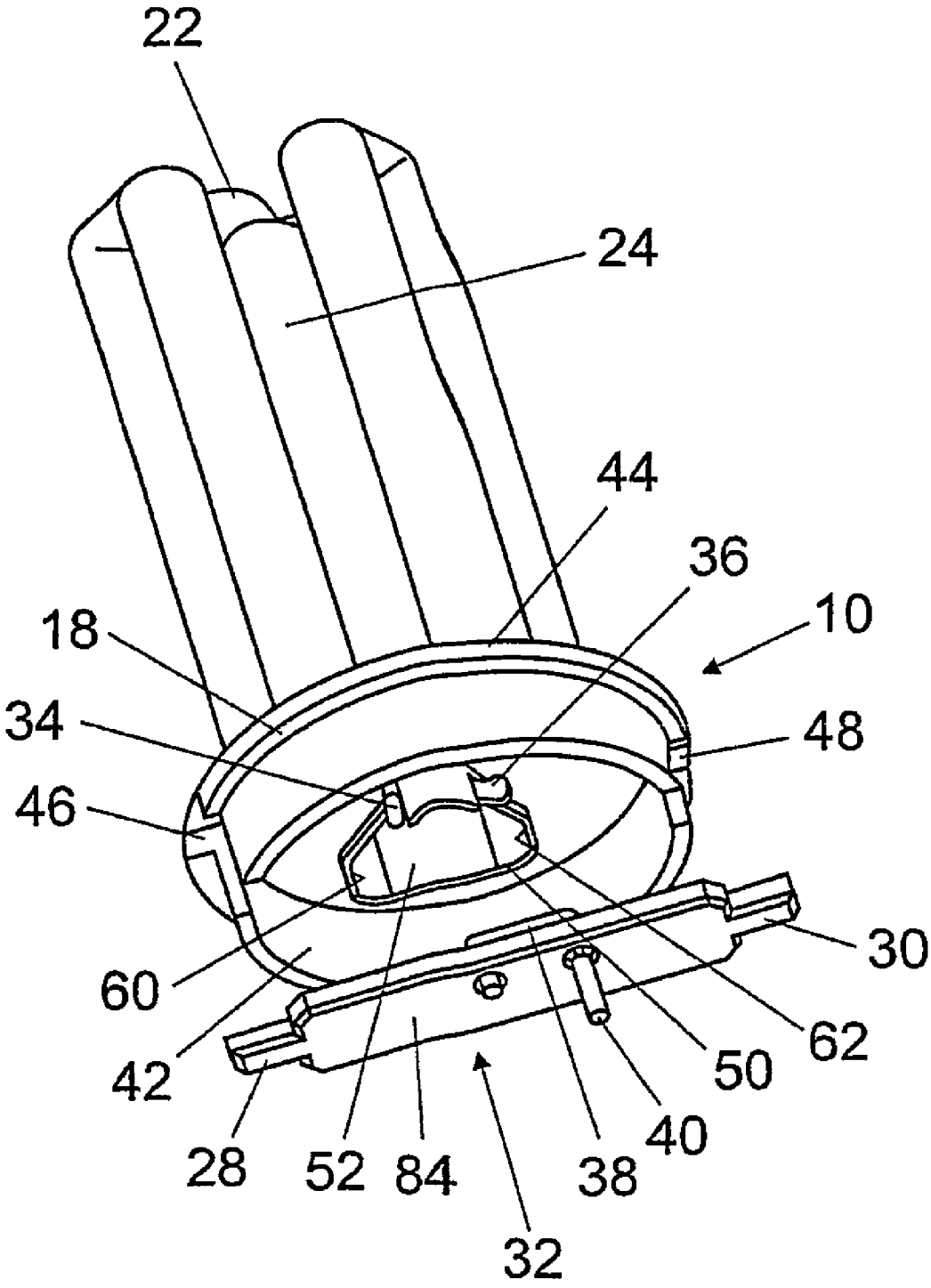
FIG. 2 shows an exploded illustration of a base cover with a discharge vessel and an LED and a slide from FIG. 1.
Figure 3:
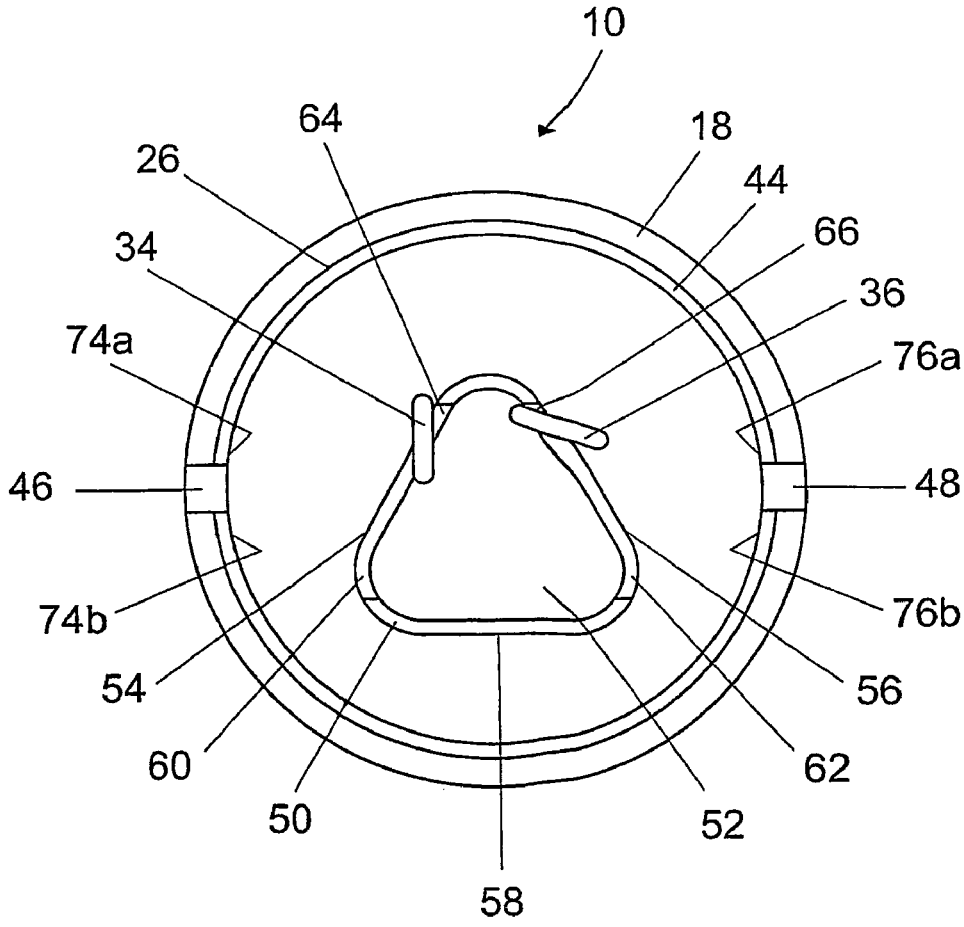
FIG. 3 shows a view from below of the base cover from FIG. 2.

As shown in FIGS. 2 and 3, the base cover 10 has an interior 42, which is delimited by a peripheral circumferential wall 44. In order to connect the base cover 10 to the base 12, the circumferential wall 44 has a radially set-back outer circumferential face 26, so that a set-back body region to be accommodated in the base 12 and an annular shoulder face 18 for bearing against a corresponding annular end face of the base 12 are formed. The connection between the base cover 10 and the base 12 preferably takes place via a snap-action connection, but adhesive bonding or welding joints are also feasible, for example. The slide 32 passes diagonally through the interior 42, two recesses 46, 48, which are arranged diametrically with respect to one another, for passing through its projections 28, 30 being formed in the circumferential wall 44.

The dome 24 is arranged centrally on the base cover 10 and extends with an extension 50 into the interior 42. The dome 24 or the extension 50 has a cavity 52, which is delimited by walls 54, 56, 58, which are arranged substantially in triangular form with respect to one another. In addition, the base cover 10 is reinforced by the dome 24 extending into the interior 42. In order to pass through the slide 32, the walls 54, 56, which are opposite the recesses 46, 48, of the dome 24 each have a cutout 60, 62, in whose corner regions 64, 66 the contact elements 34, 36 are arranged. In order to better fix the contact elements 34, 36, they are in the form of hooks, with them engaging around sections of the corner regions 64, 66.

Figure 4:
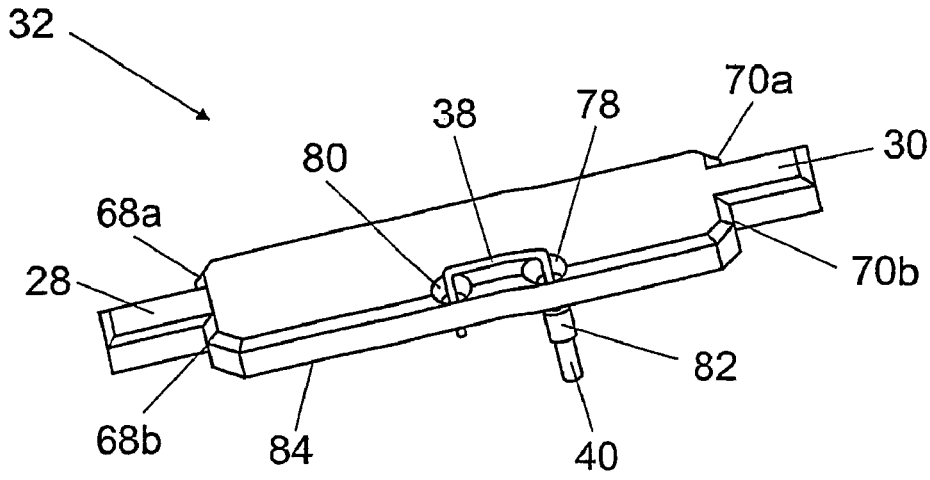
FIG. 4 shows a perspective plan view of the slide from FIG. 2.

As shown in FIGS. 2 and 4, the slide 32 has a plate-like, elongate design, the projections 28, 30 being formed on its opposite narrow sides. The projections 28, 30 are graduated symmetrically with respect to the slide longitudinal axis, so that in each case two end faces 68*a*, 68*b*, 70*a*, 70*b* are formed in the transverse direction of the slide on the narrow sides, which end faces can define a switching position and therefore an instantaneous illumination mode by means of running onto a correspondingly opposite inner circumferential section 74*a*, 74*b*, 76*a*, 76*b* of the circumferential wall 44.

In the slide 32, two drilled holes 78, 80 close to the edge for accommodating the electrical line 40 are formed in a central body region 72. In this case, the electrical lines 40 is passed downward, i.e. from a lower side 84 facing the electronics, through the first drilled hole 78 and then upward, i.e. from a side facing the base cover 10, through the second drilled hole 80. The drilled holes 78, 80 are arranged in the longitudinal direction of the slide, with a line section 38, from which the insulation has been stripped and which extends in the sliding direction, of the electrical line 40 being formed between the drilled holes 78, 80, which line section 38 can be brought into contact with at least one of the contact elements 34, 36. In the process, the line section 38 and the contact elements 34, 36 are arranged one above the other in the longitudinal direction of the lamp, i.e. in the vertical direction in the illustration in FIG. 1, so that the line section 38 and the respective contact elements 34, 36 touch in a plane which runs substantially orthogonally with respect to the longitudinal direction of the lamp. In order to prevent the electrical line 40 from being separated from the slide 32 or the line section 38 from changing its relative position on the slide 32, a clamping body, 82, for example a sleeve, is provided, which engages around sections of the electrical line 40 and is fixed in the region of the first drilled hole 78 on the facing lower side 84 of the slide 32.

As shown in the illustrations in FIGS. 3 and 4, in the event of a displacement of the slide 32 to the left, the line section 38 is connected to the left-hand contact element 34, and, in the event of a displacement to the right, to the right-hand contact element 36, so that the lamp 2 is operated in the main illumination mode or in the alternative illumination mode depending on the assignment of the contact element 34, 36 to the power supply lines. In a mid-position of the slide 32, the line section 38 is connected to both contact elements 34, 36, so that the lamp 2 is operated in the main illumination mode and in the alternative illumination mode at the same time.

In addition to the switching arrangement described here in FIGS. 1 to 4 with a slide 32, it is likewise conceivable for the switching arrangement to be designed to have, for example, a manually actuable mechanical or electronic toggle switch or pushbutton.

It is also conceivable for the dome 24 not to be passed through the base cover 10 and instead for the base cover 10 to otherwise be provided with a fixing section for the contact elements 34, 36 in the region of the extension 50.

The invention discloses a lamp with at least one light source, in particular a low-pressure discharge lamp, for producing a main illumination and with at least one alternative luminous means, in particular a light-emitting diode arrangement with at least one LED, for producing an alternative illumination, which are arranged on a base, and with electronics, a manually actuable switching arrangement for operating the lamp in the main illumination mode, alternative illumination mode or in both illumination modes at the same time being provided in the base.

LIST OF REFERENCE SYMBOLS

2 Lamp
4 Discharge tube
6 Discharge tube
8 Discharge tube
10 Base cover
12 Base
14 Connecting web
16 Connecting web
18 Annular shoulder face
20 Thread section
22 LED
24 Dome
26 Outer circumferential face
28 Projection
30 Projection
32 Slide
34 Contact element
36 Contact element
38 Line section
40 Electrical line
42 Interior
44 Circumferential wall
46 Recess
48 Recess

50 Extension
52 Cavity
54 Wall
56 Wall
58 Wall
60 Cutout
62 Cutout
64 Corner region
66 Corner region
68*a* End face
68*b* End face
70*a* End face
70*b* End face
72 Body region
74*a* Inner circumferential section
74*b* Inner circumferential section
76*a* Inner circumferential section
76*b* Inner circumferential section
78 Drilled hole
80 Drilled hole
82 Clamping body
84 Lower side

The invention claimed is:

1. A lamp comprising a plurality of discharge tubes, for producing a main illumination, arranged on a base cover of a base, and with at least one light-emitting diode arrangement with at least one LED, arranged on a dome that extends from the base cover of the base up to a region below a connection of the plurality of discharge tubes, for producing an alternative illumination, and with electronics, wherein a manually actuable switching arrangement for operating the lamp in the main illumination mode, alternative illumination mode or in both illumination modes at the same time is provided in the base.

2. The lamp as claimed in claim 1, the switching arrangement having a slide for producing an electrical connection between an electrical line of the electronics and at least one contact element of the light source or the alternative luminous means.

3. The lamp as claimed in claim 2, the electrical line being connected to the slide in such a way that a line section which extends in the sliding direction and can be brought to rest directly at least against one of the contact elements is formed.

4. The lamp as claimed in claim 2, the slide having two opposite narrow sides, on which in each case one projection for actuating the slide is formed, which projection extends through a recess in the base.

5. The lamp as claimed in claim 4, the recesses being formed diametrically with respect to one another in the base cover.

6. The lamp as claimed in claim 5, switching positions of the slide being defined by end faces running onto an inner circumferential section of the base cover in the region of the recesses.

7. The lamp as claimed in claim 2, the alternative luminous means being arranged on a dome, which extends through the base cover and has an extension with two opposite cutouts for passing through the slide, the contact elements being arranged in a corner region of the cutouts.

8. The lamp as claimed in claim 1, the light source having a discharge vessel.

9. The lamp as claimed in claim 2, the light source having a discharge vessel.

10. The lamp as claimed in claim 3, the light source having a discharge vessel.

11. The lamp as claimed in claim 4, the light source having a discharge vessel.

12. The lamp as claimed in claim 5, the light source having a discharge vessel.

13. The lamp as claimed in claim 6, the light source having a discharge vessel.

14. The lamp as claimed in claim 7, the light source having a discharge vessel.

* * * * *